United States Patent [19]

Gregg et al.

[11] 3,967,708

[45] July 6, 1976

[54] LUGGAGE CASE

[75] Inventors: James S. Gregg; Charles J. Scott; Donna A. Suiter, all of Denver, Colo.; James P. Sullivan, Tustin, Calif.; Joseph A. Woodburn, Denver, Colo.; David E. Workman, Orange, Calif.

[73] Assignee: Samsonite Corporation, Denver, Colo.

[22] Filed: Mar. 6, 1975

[21] Appl. No.: 555,858

[52] U.S. Cl. ..... 190/41 B; 190/49

[51] Int. Cl.[2] ..... A45C 5/00

[58] Field of Search ..... 190/41 R, 41 B, 49, 190/50

[56] References Cited

UNITED STATES PATENTS

| | | | |
|---|---|---|---|
| 1,638,837 | 8/1927 | Deitsch | 190/41 R |
| 1,913,021 | 6/1933 | Butterick | 190/41 B |
| 2,461,216 | 2/1949 | Kleber | 190/41 B |
| D189,868 | 3/1961 | Casselman | 190/41 R X |

*Primary Examiner*—Donald F. Norton
*Attorney, Agent, or Firm*—George J. Netter

[57] ABSTRACT

A first preformed case section with front and bottom panels and top, bottom and side flanges is joined by a hinge with a second case section constructed of two unitarily related preformed parts defining a top, back and end panels. A pair of individual latching mechanisms interconnect the end panels of the two case sections to one another. A locking-latch apparatus is provided on the top panel adjacent the handle, e.g., combination or key lock. With the second case section back wall resting on a horizontal support surface, the first case section on opening extends at 90° to the first case section, with the bottom panel stably resting on the same support surface. Platelike retainers are located on the inner lower panel surface adjacent each end and serve to prevent long garments arranged therein from being clamped between the case section edges during closing. Long garments hang from an assembly secured to the inner surface of the front panel and are held close to the inner panel surfaces by a strap secured to both retainers and passing over the garments. Optionally, a rod-like member having an end pivotally connected to one retainer for extending across the long garments is used instead of the strap.

8 Claims, 7 Drawing Figures

FIG. 1.
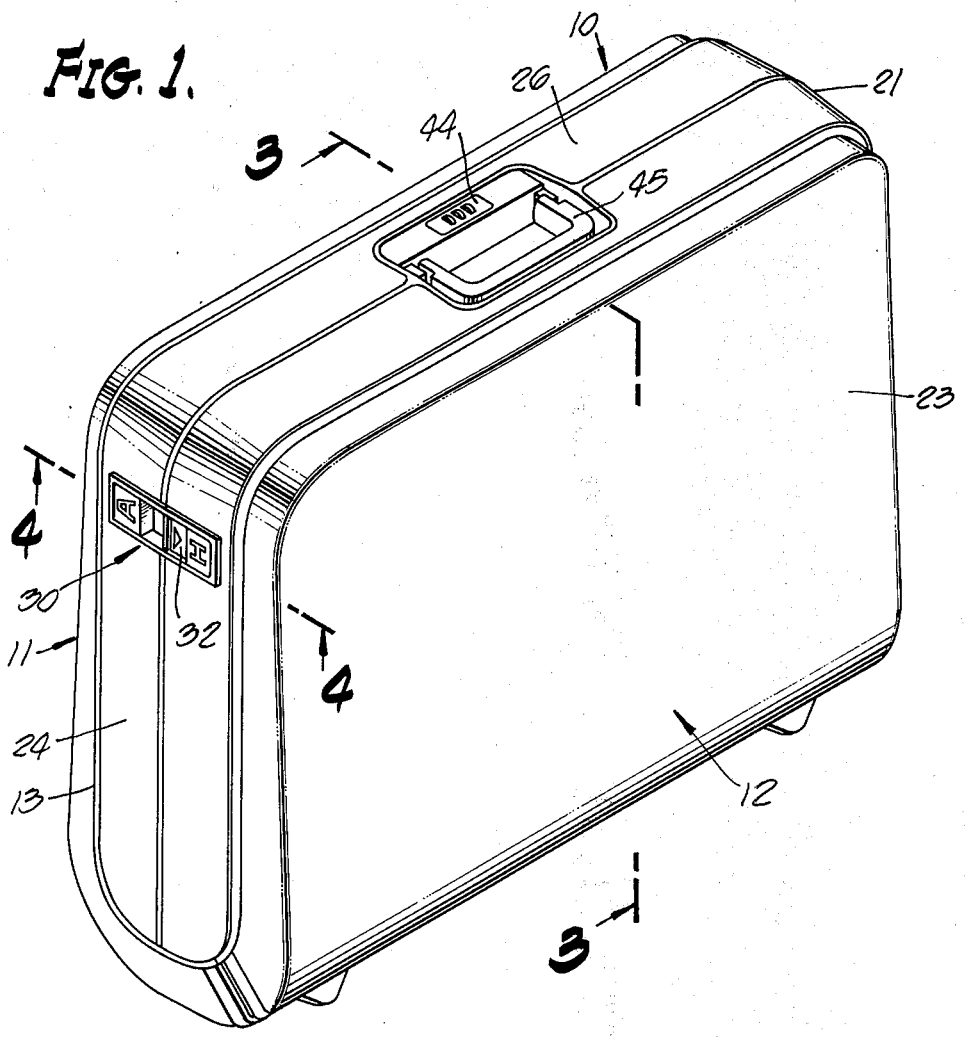
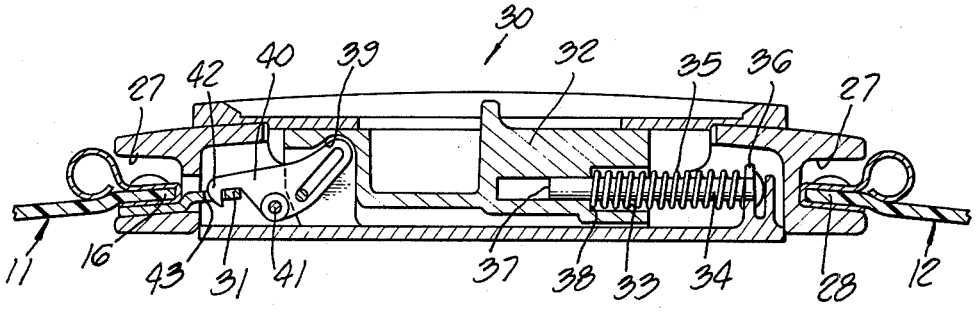
FIG. 4.

LUGGAGE CASE

The present invention relates generally to a luggage case, and, more particularly, to a so-called hard-side luggage case of the type including three preformed case parts cooperatively joined together.

OBJECTS AND SUMMARY OF THE INVENTION

A primary object and aim of this invention is to provide an improved luggage case having preformed shell-like case sections secured together.

A further object is the provision of a luggage case with preformed top, side, bottom and end panels defining two case sections which are releasably latched together via latching mechanisms located in the end panels.

Another object of the invention is the provision of a luggage case as described in the above objects in which means are provided for releasably securing relatively long apparel, e.g., suits, dresses and coats, closely adjacent the inner side and bottom wall surfaces, thereby avoiding tight folding of such long apparel.

A still further object of the invention is the provision of a luggage case as described having an improved self-latching mechanism and individually operated locking apparatus.

Yet another object is the provision of a luggage case having two case sections constructed from three preformed parts, which case, when resting on the outer face of a first side panel, opens into a stable, L-shaped, configuration with the one case section upstanding from the other case section.

These and other objects of the invention are attained in a luggage case having a first preformed case section with front and bottom panels and top, bottom and side flanges. The first case section is joined with a second case section constructed of two unitarily related preformed parts defining a top, back and end panels, the case sections being joined together by a hinge interconnecting the bottom panel with the back panel. A pair of individual latching mechanisms interconnect the end panels of the two case sections to one another. A locking-latch apparatus is provided on the top panel adjacent the handle, e.g., combination or key lock.

With the second case section back wall resting on a horizontal support surface, the first case section, on being opened, extends upwardly at substantially 90° to the first case section, with the bottom panel stably resting on the same support surface. Platelike retainers are located on the inner lower panel surface adjacent each end thereof and serve to prevent long garments arranged therein from being clamped between the case section edges during closing. Such long garments hang from an assembly secured to the inner surface of the front panel and are held close to the inner panel surfaces by a strap havings its ends secured to the retainers and passing over the garments. Optionally, a rod-like member having an end pivotally connected to one retainer means for extending across the long garments may be used instead of the strap.

DESCRIPTION OF THE DRAWING

FIG. 1 is a perspective view of the luggage case of this invention shown closed.

FIG. 4 is an enlarged, sectional plan view, taken through the latch mechanism along line 4—4 of FIG. 1.

DESCRIPTION OF PREFERRED EMBODIMENTS

Figure 2:
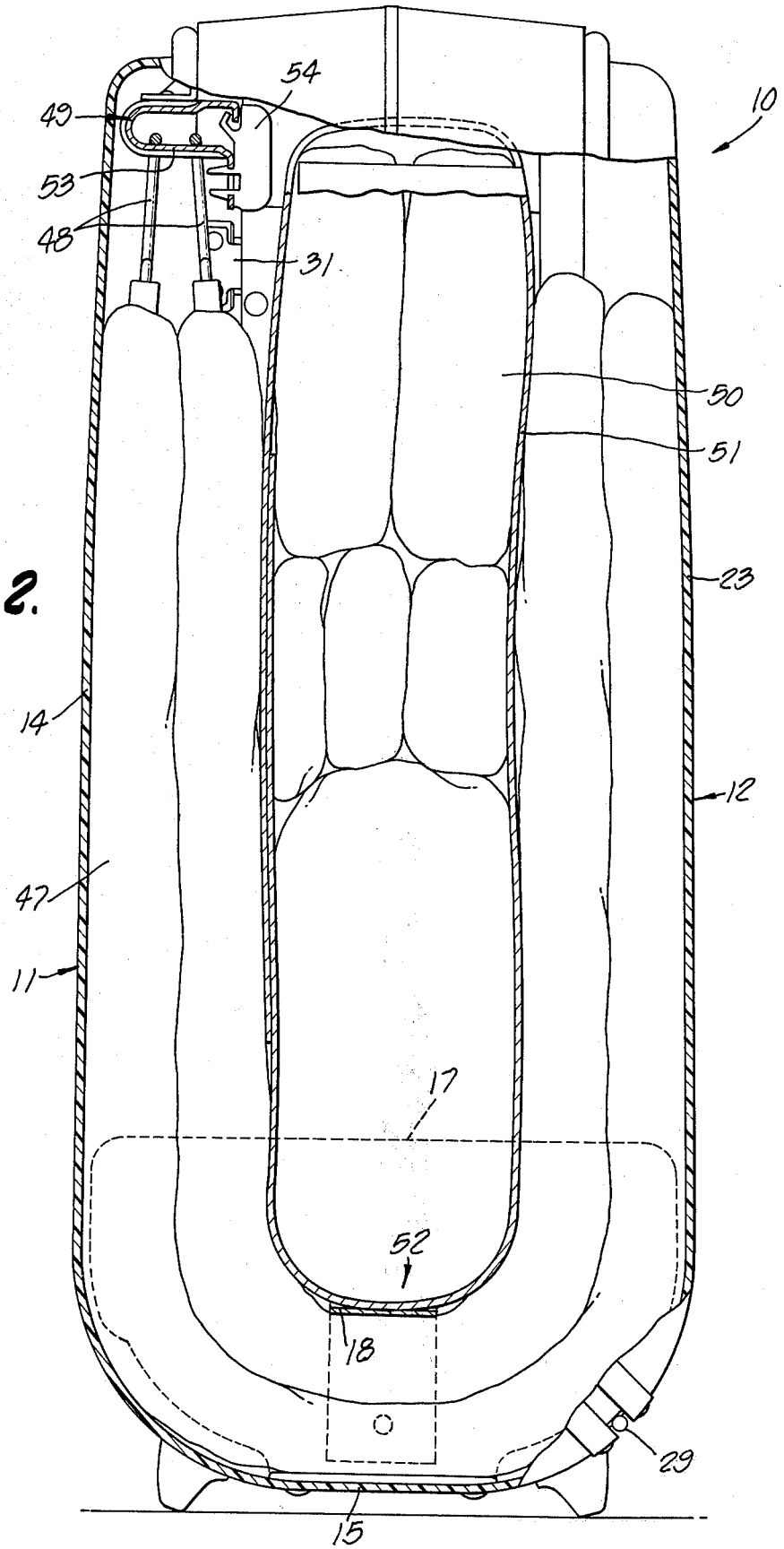
FIG. 2 is a sectional, partially fragmentary, end elevational view of the luggage case, showing clothing and other items stored therein.
Figure 3:
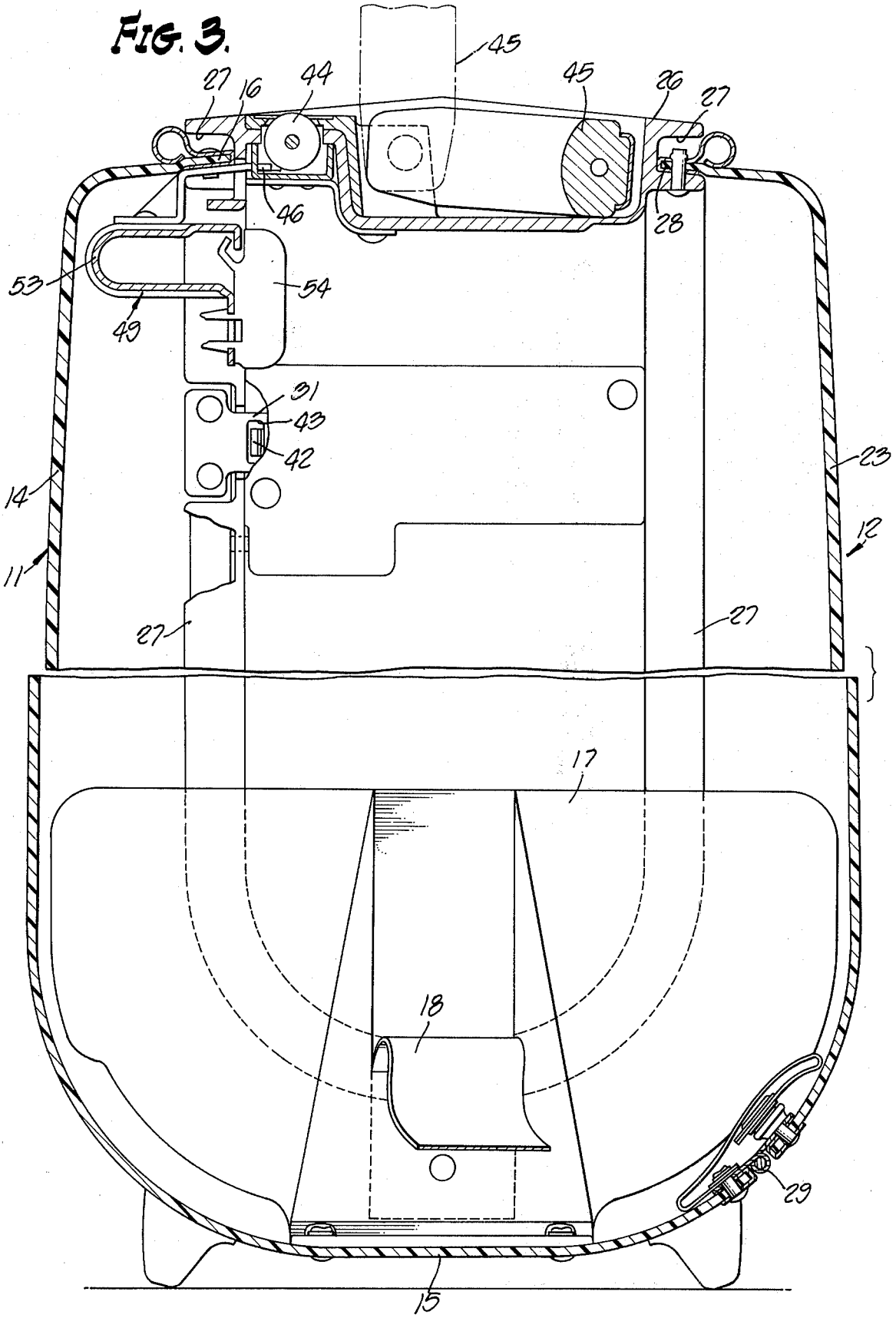
FIG. 3 is a further sectional, elevational view of the luggage case taken along line 3—3 of FIG. 1.

Turning now to FIG. 1, the luggage case of this invention is enumerated generally as at 10 and is seen to include first and second luggage case sections 11 and 12, respectively, which are releasably joined together along a line of separation 13. More particularly, and as can be best understood by simultaneous reference to FIGS. 1 and 7, the first case section 11 is generally L-shaped with a front panel 14 and a bottom panel 15 integral therewith. An inwardly projecting flange 16 is unitary with the case section 11 and extends continously along the top and both ends of the front panel, and along both ends of the bottom panel. A pair of upstanding clothing retainers and protectors 17, to be described in detail later, are mounted to the inner surface of the bottom panel 15, one at each end of the panel, and spaced slightly inwardly of the flange 16. Straps 18 and 19 each have one end affixed to a different one of the retainers 17 and are releasably interconnected at a convenient intermediate point between the retainers by a buckle 20.

Figure 5:
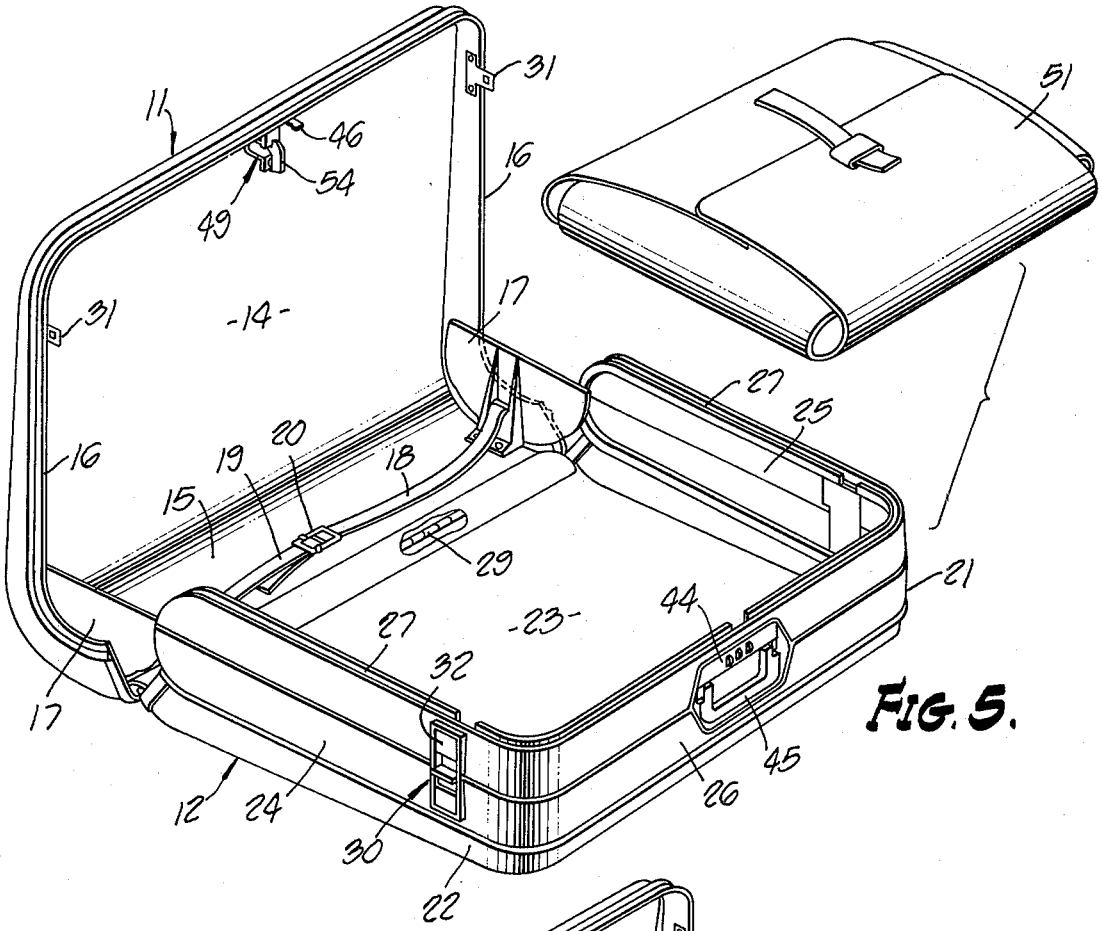
FIG. 5 is a perspective view of the luggage case in open condition.
Figure 7:
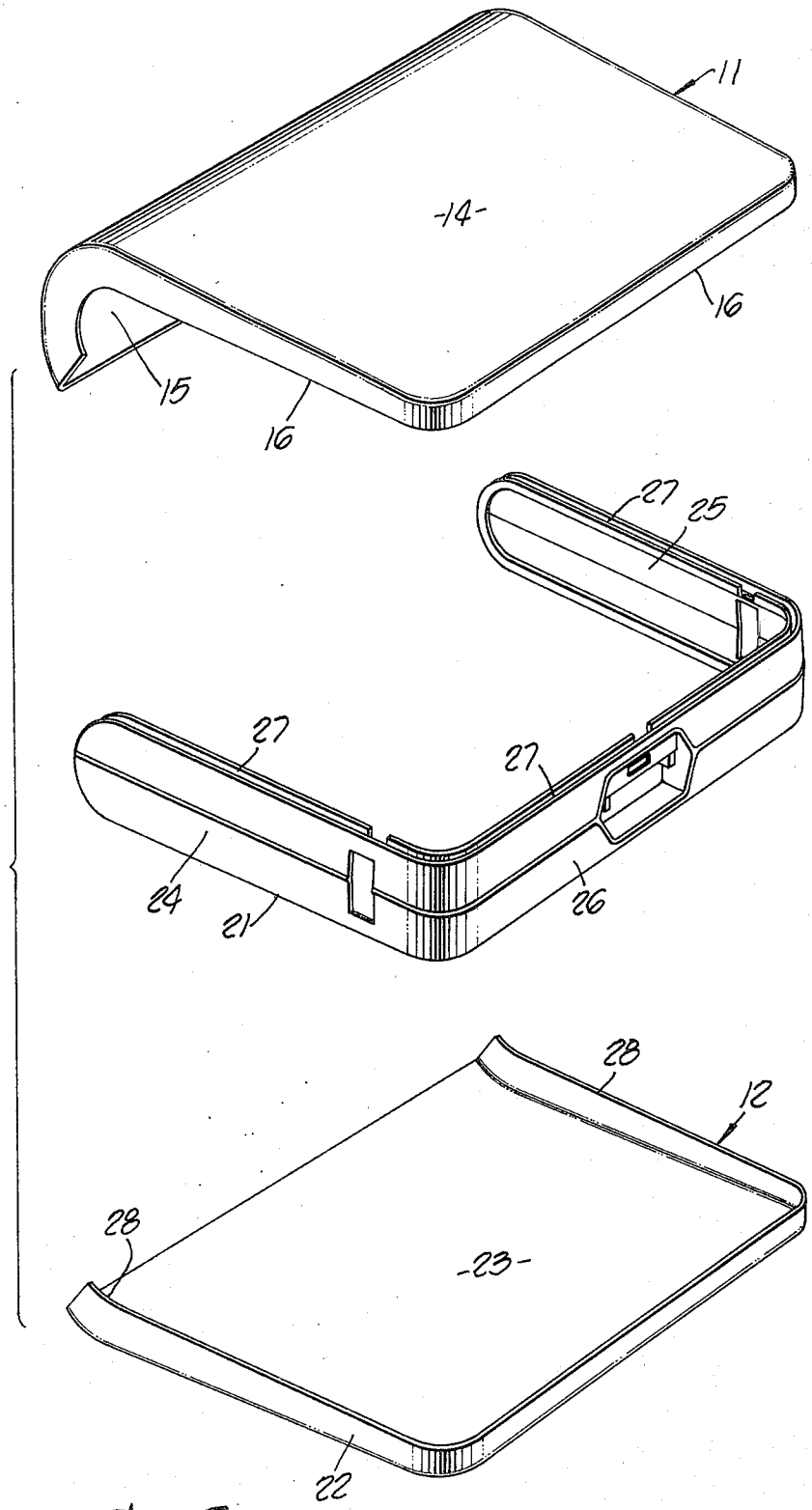
FIG. 7 is an exploded view showing the different preformed parts defining the case sections.

As seen best by comparative reference to FIGS. 5 and 7, the second case section 12, fabricated from two preformed parts 21 and 22, are unitarily joined together and cooperatively define a back panel 23, two end panels 24 and 25 and a top panel 26.

More particularly, the preformed part 21 is generally U-shaped with the cross bar defining the top panel 26 and the legs forming the respective end panels 24 and 25. The part 21 has a uniform width *d* and an inwardly directed recessed flange 27 running along the peripheral edge. This part is preferably of one-piece construction and manufactured from a suitable plastic by vacuum forming, injection molding or pressure forming.

The part 22 is a shallow shell-like construction, its major extent comprising the back panel 23. The part further includes a continuous flange 28 substantially identical to the flange 16 except lacking that portion extending along the bottom panel edge.

In assembly of the second case section 12, the flange 28 of part 22 is mated onto the flange of part 21 and suitably secured thereto (FIG. 5) along the abutting flanges.

The two case sections are pivotally joined together along the long edge of the bottom panel 15 and the lower edge of the back panel 23 by a hinge 29. By this construction, the first case section 11 may be closed onto the second case section 12 with the flange 16 encompassing and enclosing the complete recessed edge flange 27 of the end and top panels and with the retainers lying immediately inwardly of the end panels. When closed, the flange 16, as well as the corresponding flanged portion of part 22 are recessed slightly below the outer surface of the end and top panels as see best in FIG. 1.

Spaced slightly downwardly from the top panel 26 on each of the end panels 24 and 25 is a latch mechanism 30 which cooperates with an associated T-shaped hasp 31 affixed to the inner surface of flange 16 for releasably securing the case sections together.

Reference is now made to FIG. 4 for the following description of the latch mechanism details. Each end panel includes an elongated aperture extending transversely of the panel within which a similarly shaped actuator 32 is slidingly received. More particularly, one end of the actuator has an axially extending opening 33 into which a stud 34 and encompassing coil spring 35 are received. The outer end of the stud 32 is secured to the housing as at 36 and its other end 37 slides freely within the aperture 33. The coil spring has its ends fixed at 36 and against a shoulder 38 in aperture 33, thereby tending to drive the actuator 32 to the left as shown in FIG. 4. The other end of the actuator has a concavity 39 fittingly receiving an end of a pawl 40 mounted for pivotal motion about a pin 41. At its other end the pawl is formed into a hook 42 adapted for securing engagement within an opening 43 of the hasp 31 when the luggage case is closed.

As to operation of the latch mechanism 30, assume the mechanism to be engaged or closed as shown in FIG. 4. To disengage the latch, finger pressure is applied against the actuator (toward the right) which cams the pawl in such direction as to move the hook 42 out of the hasp opening, releasing the case sections and at the same time compressing the spring 35. After the case sections are released and the finger pressure removed, the coil spring 35 returns the actuator to the position shown in FIG. 4, only now the hasp 31 is removed.

As the case sections are closed onto each other, the end of each hasp 31 first cams the hook 42 upwardly a slight amount, and on further closing movement the hook drops into and engages the hasp opening 43, thereby releasably securing the case sections together.

Turning once again to FIG. 5, a locking apparatus 44, such as a combination lock, for example, is incorporated into the top panel substantially midway between the end panels and closely adjacent the handle assembly 45. When the case is closed, a clasp or hook 46, oppositely mounted onto the inner surface of the flange 16 coacts with the locking apparatus in a known manner to provide selective locking of the case sections together.

Each retainer 17 includes a platelike member with a mounting base integral therewith. When mounted onto the lower panel the retainer is upstanding with a lower edge conforming to the inner case walls and a straight line upper edge substantially parallel to the lower panel. Preferably these retainers are constructed of molded plastic and serve as previously noted to keep clothing and other items from being clamped between the case sections on closing.

Long items of apparel, such as suits and dresses 47 for example, on conventional hangers 48, are hung on a suitable support apparatus 49 affixed to the inner surface of the flange 16. These clothing items extend along the inner surfaces of the front, bottom and back panels, and are loosely secured thereto by straps 18 and 19 and buckle 20. In this manner, when the case is closed the long clothing is confined to the regions immediately adjacent the back, front and bottom panels, thereby leaving a central space for accommodating other items 50 either individually arranged therein or contained within an organizer 51 (FIG. 2). Also, it is to be particularly noted that the apparel has a relatively wide fold 52 at the bottom which reduces the tendency to wrinkle.

Still referring to FIG. 2, although other forms of hanger support means 49 may be used, it is preferred that it include a U-shaped body 53 affixed to the panel wall with access by hangers being controlled by a knob 54 adjustably rotatable to closed or open positions. Moreover, the U-shaped hanger support body is so dimensioned as to accommodate hangers of standard construction.

Figure 6:
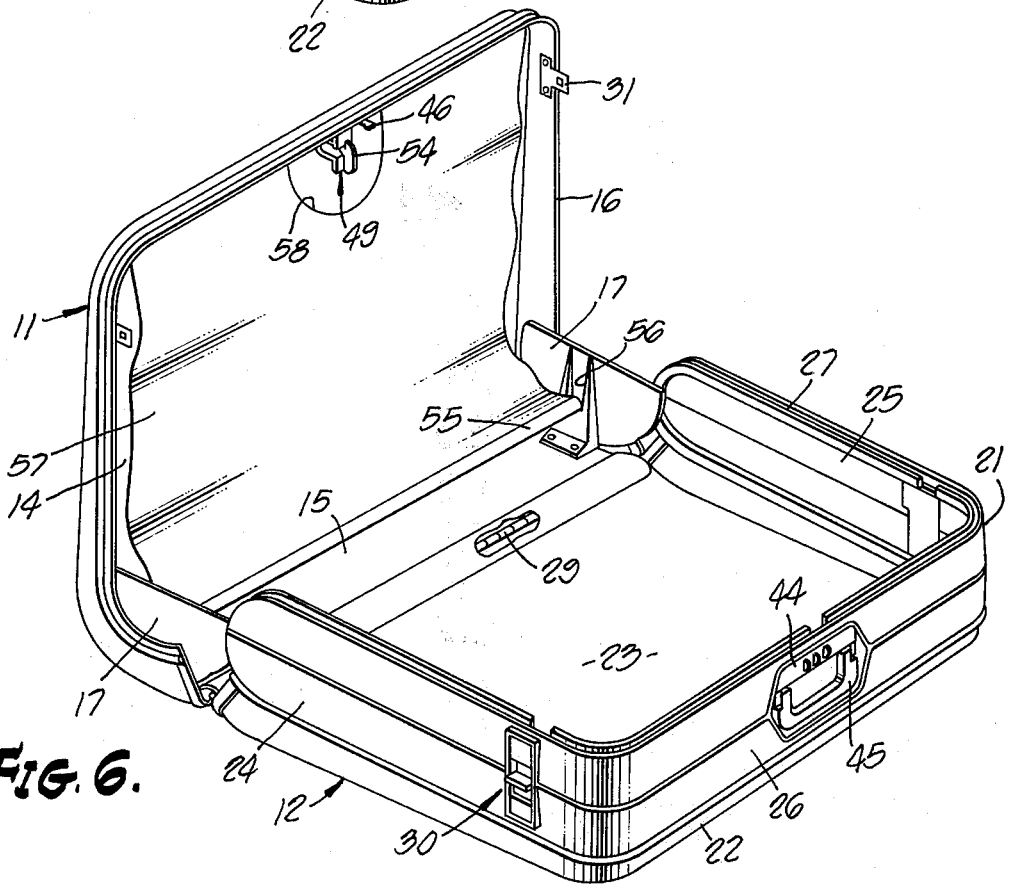
FIG. 6 is a perspective view similar to FIG. 5, showing an alternate embodiment of clothes retaining means therein.

Turning now to FIG. 6 and an alternate form of the invention, the straps 18 and 19 of the first described embodiment are replaced by a rod 55 having its ends releasably engaged within notches or recesses 56 in the retainers. That is, the length and cross-section of the rod 55 are such that when its ends are received within the retainer notches, a certain amount of interference occurs, thereby providing retentive securement.

A fabric curtain 57 is affixed to the inner surface of the front panel 14 adjacent the top flange and extends downwardly along the front panel and has its lower end secured to the rod 55. A portion of the curtain is removed as at 58 to accommodate the hanger mounting apparatus 44.

In use, the rod and curtain are lifted out of the way and the long apparel items on hangers are hung as shown in FIG. 2. The curtain 50 is then draped down over the apparel items and the rod snapped into place in the retainer notches. In this way the clothing items are held against the case inner wall in the desired manner.

Further as to use of the described luggage case, when fully open, with the back panel resting on a horizontal surface, the second case section 11 rests stably on the bottom panel and, accordingly, is upstanding as in FIGS. 5 and 6. The case when so oriented presents an overall L-shaped appearance with all interior surfaces and storage space conveniently at hand.

The described luggage case is relatively simple and inexpensive to manufacture. The major parts are a U-form member which is combined with a shallow shell to provide the second case section 12, and an L-shaped shell which is hingedly joined to the second case section. Each of these major parts 11, 21 and 22, may be individually manufactured by injection molding, vacuum or pressure formed, or, optionally, the parts 21 and 22 may be manufactured as one item. The overall appearance of the case is further enhanced by the handle 45, lock 44 and latch mechanisms 30 all being recessed below the outer panel surfaces.

We claim:

1. A luggage case, comprising:

a first L-shaped rigid case section having a side panel and a bottom panel with open sides and top;

a second rigid case section including, a U-shaped shell defining top and end panels, and a shallow shell side panel affixed over one side of the U-shaped shell leaving the bottom and other side of the U-shaped shell open; and means pivotally interconnecting the exposed edge of said shallow shell side panel with the bottom panel of said L-shaped case section such that the L-shaped case section is pivotable to a position such that the side panel of said second case section lies in the same plane with the plane of said L-shaped case section bottom panel.

2. A luggage case as in claim 1, in which there are further provided a pair of platelike means upstanding from the inner surface of the L-shaped case section bottom panel and spaced inwardly, respectively, from the end panels when the case sections are closed onto one another.

3. A luggage case, comprising:

a first rigid case section having a side panel, a bottom panel and a continuous flange on the top and end edges of said side panel and end edges of said bottom panel;

a second rigid case section having back, top and end panels with an open front and bottom;

said first and second case sections being hingedly joined along a bottom panel edge of the first case section and the lower edge of the back panel, and said case sections being pivotable to close on each other with the flange overlapping the edge margins of the top and end panels; and platelike retainer means affixed to the bottom panel, spaced slightly inwardly from the flange and positioned adjacent each of the end panels when the case sections are closed on each other, and belt means connected to said retainer means and extending therebetween.

4. A luggage case, comprising:

a first rigid case section having a side panel, a bottom panel and a continuous flange on the top and end edges of said side panel and end edges of said bottom panel;

a second rigid case section having back, top and end panels with an open front and bottom;

said first and second case sections being hingedly joined along a bottom panel edge of the first case section and the lower edge of the back panel, and said case sections being pivotable to close on each other with the flange overlapping the edge margins of the top and end panels; and a pair of retainers affixed to the inwardly directed surface of the bottom panel, spaced from the flange;

clothes hanger support apparatus secured to the inner flange surface;

a flexible sheetlike member secured to the inwardly directed surface of said first case section; and a rodlike member having its ends releasably secured to the retainers and its intermediate portion connected to the flexible sheetlike member.

5. A luggage case, comprising:

a first rigid case section having a side panel, a bottom panel and a continuous flange on the top and end edges of said side panel and end edges of said bottom panel;

a second rigid case section having back, top and end panels with an open front and bottom;

said first and second case sections being hingedly joined along a bottom panel edge of the first case section and the lower edge of the back panel, and said case sections being pivotable to close on each other with the flange overlapping the edge margins of the top and end panels; and platelike retainers arranged spaced slightly inwardly from the flange and positioned respectively adjacent each of the end panels when the case sections are closed on each other, and belt means connected to said retainer means and extending therebetween.

6. A luggage case, comprising:

a rigid L-shaped case section having a side panel, a bottom panel, and a flange along the top and end edges of said side panel and end edges of said bottom panel;

a second rigid case section including, a U-shaped shell forming top and end panels with open sides and bottom, and a side panel affixed to said U-shaped shell covering one open side of said U-shaped shell;

a hinge interconnecting the exposed edge of said shell side panel with the bottom panel of said L-shaped case section such that the L-shaped case section is pivotable to a position such that the side panel of said second case section lies in the same plane with the plane of said L-shaped case section bottom panel;

latching means mounted on each end panel of the second case section;

means mounted on the flange of said first case section for cooperating with said latching means when the case sections are closed on each other to releasably secure them together; and means mounted on the second case section top panel coacting with means carried by the first case section flange for locking the case sections together.

7. A luggage case, comprising:

a rigid L-shaped case section having a side panel, a bottom panel, and a flange along the top and end edges of said side panel and end edges of said bottom panel;

a second rigid case section including, a U-shaped shell forming top and end panels with open sides and bottom, and a side panel affixed to said U-shaped shell covering one open side of said U-shaped shell;

a hinge interconnecting the L-shaped case section to said second case section;

latching means mounted on each end panel of the second case section;

means mounted on the flange of said first case section for cooperating with said latching means when the case sections are closed on each other to releasably secure them together; and platelike retainer means affixed to the bottom panel and spaced inwardly of the flange when the case sections are closed on each other.

8. A luggage case as in claim 7, in which there are provided a pair of said retainer means affixed to the inwardly directed surface of the bottom panel and spaced from the flange;

clothes hanger support apparatus secured to the inner flange surface;

a flexible sheetlike member secured to the inwardly directed surface of said first case section; and a rodlike member having its ends releasably secured to the retainers and its intermediate portion connected to the flexible sheetlike member.

* * * * *